US006755301B1

(12) United States Patent
Cassese et al.

(10) Patent No.: US 6,755,301 B1
(45) Date of Patent: Jun. 29, 2004

(54) STAPLER CASSETTE FOR PACKAGING AND DISPENSING STAPLES IN PARTICULAR IN AN AUTOMATIC FRAME ASSEMBLING MACHINE

(75) Inventors: Pierre Cassese, St Ouen en Brie (FR); Alain Cassese, Breau (FR); Jean Cassese, Guigues (FR); Philippe Cassese, St Germain Laxis (FR)

(73) Assignee: Societe Cassese, Verneuil l'Etang (FR)

( * ) Notice: Subject to any disclaimer, the term of this patent is extended or adjusted under 35 U.S.C. 154(b) by 32 days.

(21) Appl. No.: 10/070,446

(22) PCT Filed: Sep. 8, 2000

(86) PCT No.: PCT/FR00/02489

§ 371 (c)(1),
(2), (4) Date: Jun. 3, 2002

(87) PCT Pub. No.: WO01/21364

PCT Pub. Date: Mar. 29, 2001

(30) Foreign Application Priority Data

Sep. 21, 1999 (FR) ..... 99 11760

(51) Int. Cl.[7] ..... B65D 85/24

(52) U.S. Cl. ..... 206/340; 206/338

(58) Field of Search ..... 206/338, 340, 206/343; 227/109, 120; 221/87, 124, 131, 197, 198

(56) References Cited

U.S. PATENT DOCUMENTS

| | | | | | |
|---|---|---|---|---|---|
| 2,266,534 | A | * | 12/1941 | Cavanagh | 206/340 |
| 4,018,360 | A | * | 4/1977 | Strauss | 221/310 |
| 4,243,145 | A | * | 1/1981 | Woodhead | 211/59.2 |
| 4,687,098 | A | * | 8/1987 | Ebihara | 206/340 |
| 5,325,975 | A | * | 7/1994 | Brown et al. | 211/189 |
| 5,575,415 | A | | 11/1996 | Sucher | |
| 5,862,943 | A | * | 1/1999 | Larit | 221/131 |

* cited by examiner

*Primary Examiner*—David T. Fidei
(74) *Attorney, Agent, or Firm*—Arent Fox PLLC

(57) ABSTRACT

A thin cassette provided with a plurality of passages separated by partitions and open outwards at the front orifices, and at a rear side. On the rear side, each passage is equipped with a driver resting against the staples contained therein.

3 Claims, 1 Drawing Sheet

STAPLER CASSETTE FOR PACKAGING AND DISPENSING STAPLES IN PARTICULAR IN AN AUTOMATIC FRAME ASSEMBLING MACHINE

BACKGROUND OF THE INVENTION

1. Field of the Invention

The invention relates to a staple cassette adaptable in particular to an automatic frame assembling machine.

2. Description of the Related Art

It is known that staples which are intended for fixing, between themselves, the parts of a frame must have a profile and dimension adapted to the mouldings used. For each of the categories or sizes of staples, the latter are, as they are manufactured, placed against each other inside a loader which is in the form of an elongated receptacle. The role of this loader is thus not only to package a pack of staples and make it easier to handle them, but also to serve as a dispenser in frame stapling machines. But, in high-speed automatic machines, these loaders are clearly inadequate. Efforts are therefore being made to produce dispensing magazines with a greater capacity, making it possible to package a large number of staples and allowing them to be automatically dispensed at a machine's stapling station.

SUMMARY OF THE INVENTION

The invention advantageously solves this problem by proposing a staple cassette serving as a packaging and dispensing means for an automatic stapling machine.

The object of the invention is thus a staple cassette for packaging and dispensing staples, in particular in an automatic frame assembling machine, which is thin and has a plurality of passages separated by partitions, and open towards the outside at the front by means of orifices, as well as at the rear where each passage is provided with a driver resting against the staples contained therein.

Advantageously, grooves in the shape of the arc of a circle are formed by each orifice in the upper and lower curved panels of the cassette.

Additional characteristics, advantages and preferred methods of use of the cassette according to the invention will be better understood by reading the following description of an example in which reference is made to annexed drawings representing:

DETAILED DESCRIPTION OF THE INVENTION

Figure 1:
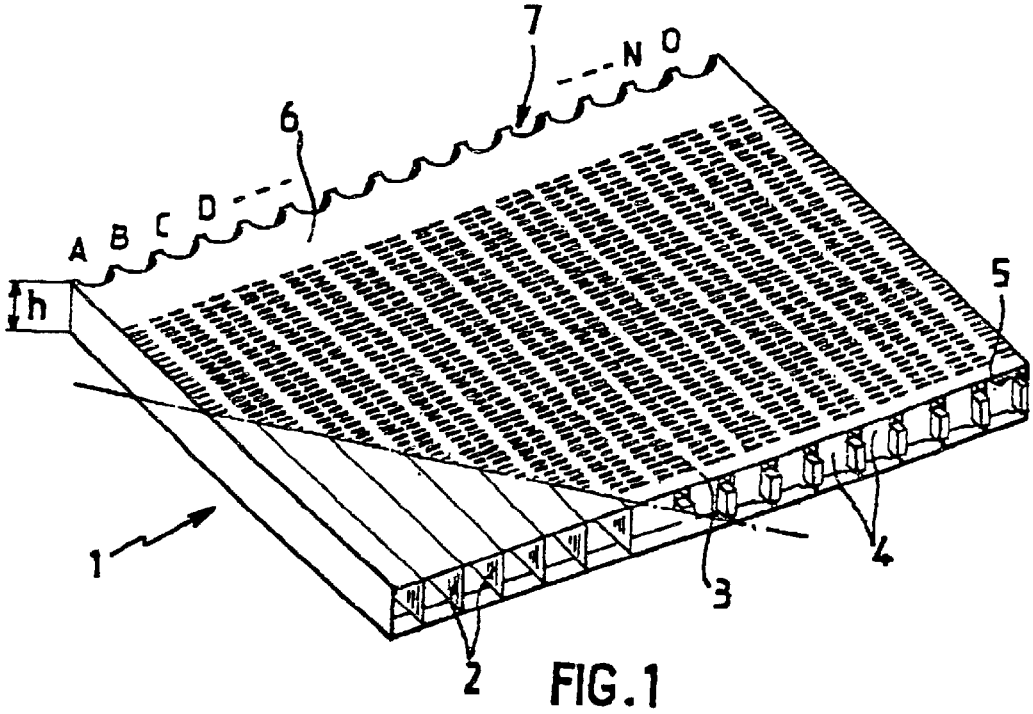
FIGS. 1 and 2, perspective views of the staple cassette, rear view and front view respectively.
Figure 2:
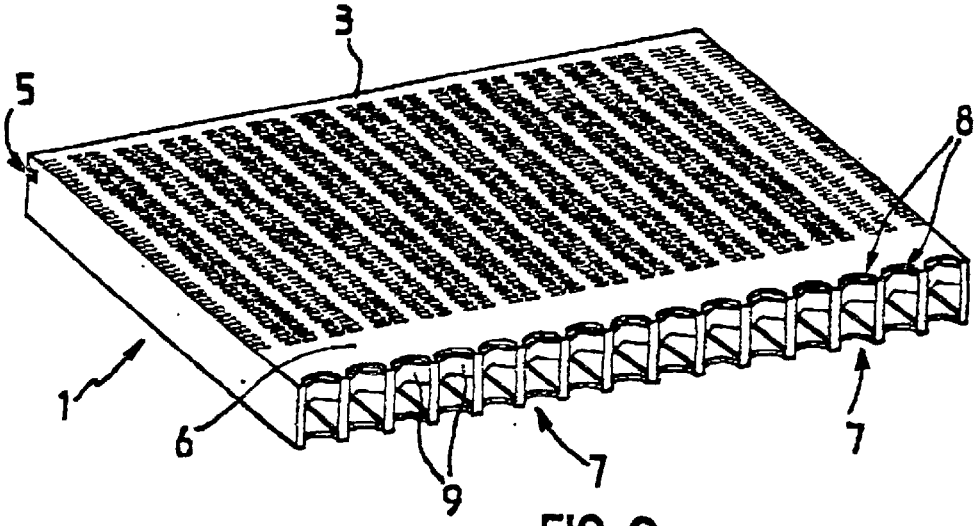

The staple cassette referred to as a whole by the reference 1 and shown in the figures in the general form of a flat case of slight thickness h. In the direction of its depth it has fifteen passages A, B, C . . . O, separated by partitions 2. At the rear side 3 of the cassette, the passages are open to the outside. Each of them is provided with a driver 4 resting against the staples contained in the corresponding passage. Moreover, each passage is edged, still at the rear side, with locators 5, shown as notched portions in FIG. 2.

At the front side 6 of the cassette 1, the passages are also open to the outside. Each orifice 7 forms, in the upper and lower curved panels of the cassette, a groove 8 in the shape of an arc of a circle, allowing the passage to interact with the machine head. Through the orifices 7 the ends of the staples 9 can be seen stored in the passages.

The drivers 4 hold the staples 9 in position pushed forward towards the side 6.

The cassette thus described, being thin, easily lends itself to stacking. Thus several superposed cassettes can be loaded in a magazine feeding an automatic stapling machine. Each cassette is provided with identical staples of the same height. On the other hand, it is possible to stack cassettes provided with staples of different heights. It is then up to the user to choose the cassettes on the basis of the type of moulding to be stapled. When a cassette is empty, the magazine automatically loads a new one. The empty cassette is then pushed by the new cassette until it falls into a receptacle provided for this purpose.

What is claimed:

1. Staple cassette for packaging and dispensing staples in particular in an automatic frame assembling machine, said staples being placed against each other inside a loader which is in the form of an elongated receptacle, characterized in that said cassette is thin and is provided with a plurality of passages in the direction of its depth, separated by partitions and open to the outside at the front side through orifices and at the rear side and in that, at the rear side, each passage is provided with a driver resting against the staples contained therein.

2. Staple cassette according to claim 1 characterised in that each passage is edged, at the front side of the cassette, with locators.

3. Staple cassette according to claim 1 characterised in that grooves in the shape of the arc of a circle are formed by each opening in the upper and lower curved panels of the box.

* * * * *